US005232142A

United States Patent [19]

Reichert et al.

[11] Patent Number: 5,232,142

[45] Date of Patent: Aug. 3, 1993

[54] STAPLER

[76] Inventors: Abraham H. Reichert, 20 Ezra Street, Rehovot, Israel, 76201; Yehuda A. Malik; Gregory A. Dubrovski, both of P.O.B. 498, Nes-Ziona, Israel, 70454

[21] Appl. No.: 906,485

[22] Filed: Jun. 30, 1992

[51] Int. Cl.[5] ..... B25C 5/02

[52] U.S. Cl. ..... 227/119; 227/134; 227/156

[58] Field of Search ..... 227/132, 134, 127, 128, 227/90, 81, 107, 119, 143, 144, 156

[56] References Cited

U.S. PATENT DOCUMENTS

| | | | |
|---|---|---|---|
| 2,147,380 | 2/1939 | Peterson | 227/134 |
| 2,574,988 | 11/1951 | Vogel | 227/134 |
| 2,795,787 | 6/1957 | Spencer | 227/144 X |
| 4,763,825 | 8/1988 | Albin | 227/143 X |

*Primary Examiner*—Frank T. Yost
*Assistant Examiner*—Rinaldi Rada
*Attorney, Agent, or Firm*—Jacobson, Price, Holman & Stern

[57] ABSTRACT

A paper binding apparatus such as staplers in the form of a thin, compact device employing pre-formed U-shaped staples where the staples are pushed through the papers by pressure applied directly by a hand pressing one of the stapler bars. The stapler enables a reduction in size of the stapler's dimensions, in particular its width, so that its width would be determined only by the thickness of the magazine. The stapler is based on performing the "stapling operation" in two steps. Initially, the stapler is closed and the magazine is parallel to the direction of the moving driving mechanism. The second stage, the operational one is that at which the magazine becomes perpendicular to the direction of movement of the driving mechanism.

6 Claims, 2 Drawing Sheets

11
12
13
14
14'
15
16
17
18
19
20
21
22
23
24
25

STAPLER

FIELD OF THE INVENTION

The present invention relates to a paper binding device in particular staplers, and specifically the field of thin, compact staplers. The stapler can be defined as an instrument used to bind together several leafs of paper, by employing metal staples which penetrate the papers from one side, and after passing through the stack of paper sheets, the two prongs are bent as a result of being stopped by the staple base (hereafter the anvil) on the other side. In principle, the staplers can be subdivided into two main groups. The first group comprises the staplers which bend a straight pin or nail-like piece of metal into a U-shaped form, and then perform the stapling operation. The second group is that of the staplers employing pre-formed, U-shaped staples. In this case the operation of the stapler reduces to pushing the staples through the sheaf of papers, and bending them to conclude the stapling operation. A different classification of the staplers may differentiate between manual staplers (where the staples are pushed through the papers by pressure applied directly by a hand pressing one of the stapler bars) versus those staplers which are manipulated by an electrical or pneumatic power source. British patent number 1046013 describes a manual stapler which bends the pins (staples) before it is driven into the sheaf of papers. British patent 983460 describes a stapler which thrusts (inserts) a U-shaped pre-formed staple. These patents, and other patents, all describe various staplers whose common denominator is the fact that they all describe staplers which basic construction is the same, namely the magazine containing the staples is perpendicular to the direction of movement of the metal-strip tongue (hereafter, the ejector) which is the implement that pushes the staples through the papers to be joined. These staplers are characterized by their shape and their dimensions.

Their size is dictated by considerations of the length of the magazine and the width of the staples (which is usually from twice to four folds the height of the staple). An additional characteristic is the shape of the stapler, which resembles a V-shaped implement lying on its long side, where in one of the two arms (of the V) the ejector and the magazine are located, and the other arm is the counter-anvil against which the pins are bent after going through the sheaf of papers.

SUMMARY OF THE INVENTION

The invention enables a reduction in size of the stapler's dimensions, in particular its width, so that its width would be determined only by the thickness of the magazine (to which it will be equal). The invention is based on performing the "stapling operation" in two steps. Initially, the stapler is closed and the magazine is parallel to the direction of the moving ejector. The second stage, the operational one is that at which the cartridge becomes perpendicular to the direction of the thruster. The change in the orientation of the magazine is achieved by pressing the ejector in the direction of staple insertion. While this movement is performed, the magazine turns from the parallel to the perpendicular orientation. When the magazine reaches the perpendicular orientation, the ejector is situated above a staple. By maintaining the "pressing" action, a staple is separated from the magazine and pierces through the papers.

DESCRIPTION OF THE PREFERRED EMBODIMENTS

Figure 1:
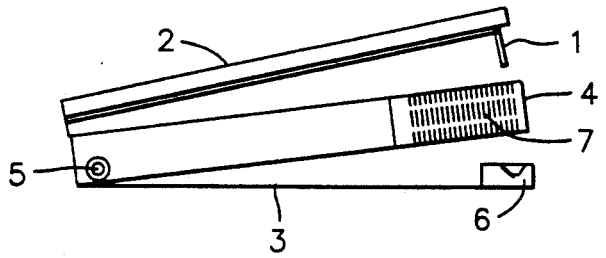
FIG. 1 (PRIOR ART)
FIG. 1 is a presentation of prior art.

The basic construction of a known stapler is described in FIG. 1, which also presents the prior art. The body is connected by a pivot to the base at which the anvil is connected.

A metal blade which enables driving the staple into the sheaf of papers is connected to the body. This construction operates in a scissors-like manner, where the three central parts—the base, the magazine containing the staples and the blade 1 are connected on one axis and their relative motions is angular, while the anvil is perpendicular to the plane at which the driving action takes place.

Figures 2A, 2B, 2C, 2D:
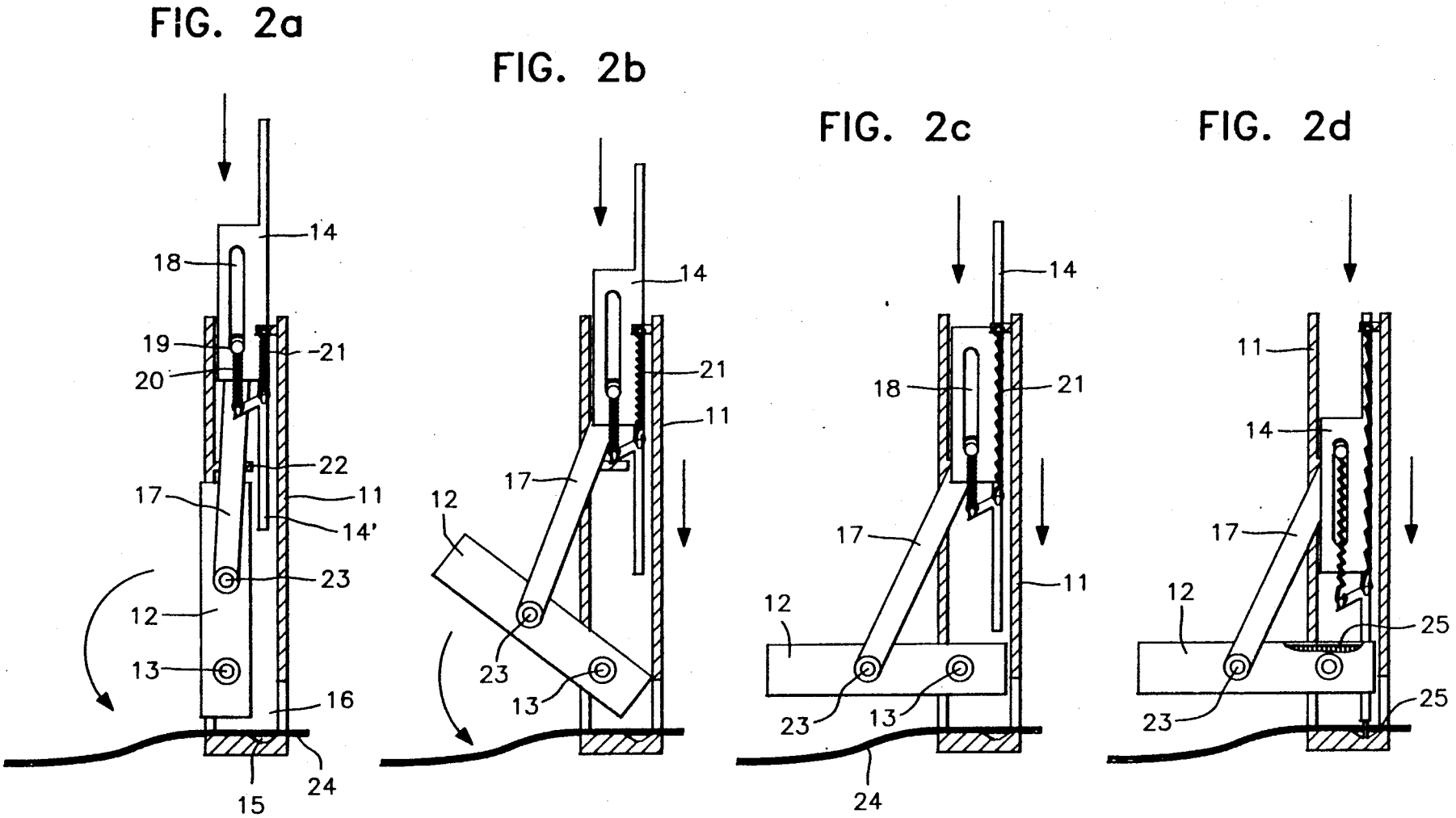
FIG. 2*a* shows the stapler in its closed configuration, the magazine is parallel to the body of the stapler.
FIG. 2*b* shows the position of the stapler after the initial, light pressure was applied.
FIG. 2*c* shows the magazine in its "perpendicular to the body" position.
FIG. 2*d* shows the driving mechanism driving the staple through the sheaf of papers.

FIGS. 2*a* and 2*d* illustrate by a side partial cross section of a preferred embodiment and depicts the stages of the staple operation. FIG. 2*a* describes the stapler in its closed starting position. The main components of the stapler are: stapler body 11, the magazine 12 driving mechanism 14. The magazine 12 is pivotally connected to the body by a pivot 13 which enables its circular movement. The magazine 12 is also connected to an arm 17 at 23, the free end thereof is connected to the driving mechanism 14 by means of pin 19 which slides in a slot 18 within the driving mechanism. The pin 19 is connected to the driving mechanism 14 by a spring 20. The driving mechanism 14 moves linearly inside the body while a second spring 21 is connected thereto and to the body 11. The sheets of papers (to be stapled) 24 is inserted through an opening 16 in the body 11. The anvil 15 at the bottom of the opening causes the bending of the staple after it has pierced through the sheaf of papers in the usual manner.

As can be seen in FIG. 2*b*, after pressure is applied on the upper end of the driving mechanism, the linear movement of the driving mechanism is transferred via the spring 20 to the upper pin 19 of the arm 17 which applies pressure on the magazine and drives it to rotate about its axis 13.

FIG. 2*c* illustrates the position of the stapler after an additional pressing action which turns the magazine around so that it is perpendicular to the direction of action of the applied pressure. The magazine remains at this state, as the linear movement of the pin 19 is stopped by the protrusion 22 which is part of the body and prevents the/any continued movement of the arm 17. At this position, the blade 14' of the driving mechanism is placed above one staple and is ready to perform the stapling operation.

FIG. 2*d* illustrates the actual stapling operation: the driving mechanism 14 continues its linear movement and as a result of its movement, blade 14' separates one staple 25 from the staples' magazine 12, drives it through the sheaf of papers 24 until it is finally bent against the anvil 15 located on the other side of the opening 16.

Figure 3:
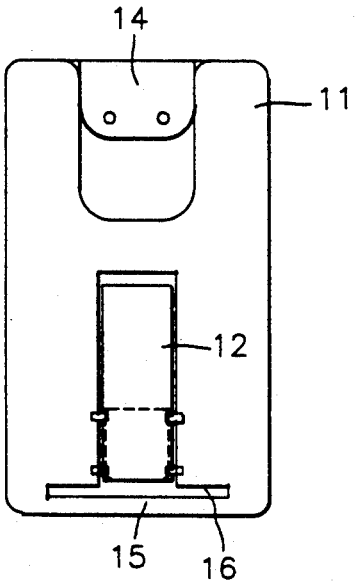
FIG. 3 is a front view of the first preferred embodiment, the anvil is static (not in motion) during the piercing operation.

Referring to FIG. 3, which is a front view of the first preferred embodiment. In this embodiment the stapler is at its closed state as in FIG. 2*a*. The anvil 15 is located inside opening 16 and constitutes an integral, rigid part of the body. When this form of stapler is used, a sheaf of papers can be stapled only at one of the four corners of the sheaf of papers.

Figure 4:
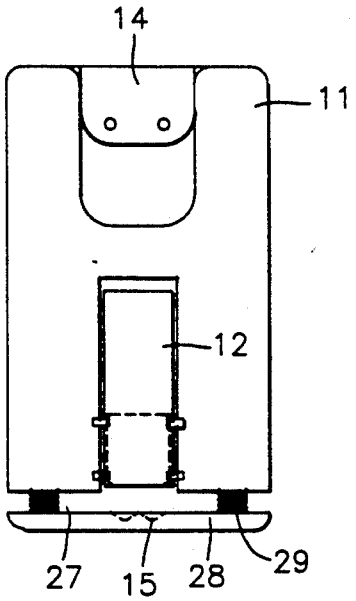
FIG. 4 is a front view of the second preferred embodiment, the anvil moves towards the stapler during the stapling operation.

Referring to FIG. 4, which is a front view of the second preferred embodiment. In this embodiment the anvil 15 is located on a support 28 which is fastened to the body 11 by two springs 29 which press it lightly. This form of stapling causes the papers to be pressed against the staplers body during the stapling operation.

Figure 5:
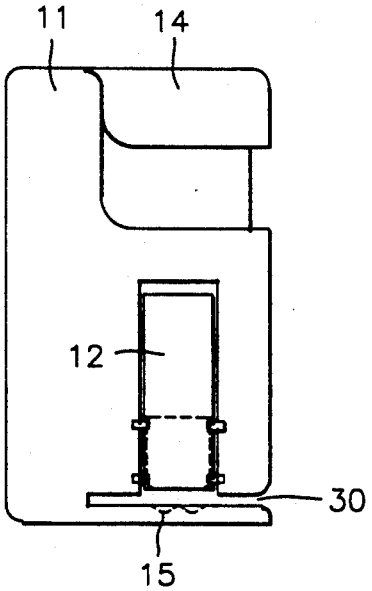
FIG. 5 is a front view of the third preferred embodiment, the anvil is at rest during the stapling operation.

Referring to FIG. 5, being a front view of the third preferred embodiment. In this embodiment, the stapler is at its closed state. The anvil 15 is located inside opening 30 and constitutes an integral, rigid part of the body 11. When this form of stapling is used, a sheaf of papers can be stapled at any desired located around the perimeter of the pages.

Figure 6:
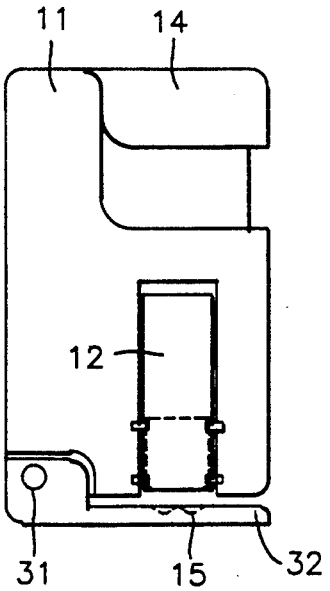
FIG. 6 is a front view of the fourth preferred embodiment, the anvil moves towards the stapler during the stapling operation.

Referring to FIG. 6, being a front view of the fourth preferred embodiment. In this embodiment the anvil 15 is located on a support 32 which is capable of moving relative to the body around pivot 31. This form of stapling causes the papers to be pressed unto/against the body during the stapling operation. In such stapling, a sheaf of papers can be stapled at any desired location around the circumference/perimeter of the pages.

The stapler functions in the following manner: applying pressure on the driving mechanism which is connected to the magazine causes the magazine to rotate from its upright position to a position which is perpendicular to the body of the stapler, continued linear movement of the driving mechanism separates one staple from the pack stored in the magazine and drives it into the sheaf of papers which was entered into the opening between the body and anvil. After traversing the papers, the staple is bent against the anvil mounted on said body, and after completion of the operation the assembly reverts to its original position, aided by a spring loaded mechanism, simultaneously causing the staples magazine to revert to its starting position, parallel to said driving mechanism and to the body of the stapler.

We claim:

1. A stapler, comprising:

an elongated body; and a magazine for staples, means pivotally supporting the magazine from the body to enable movement of the magazine from an initial position parallel to the body to a stapling position perpendicular to the body; and a staple driving mechanism mounted on the body to enable linear movement within said body;

an anvil connected to said body and defining an opening for insertion of a sheaf of papers, said driving mechanism being linked to said magazine in such a manner so that said linear movement causes the magazine to pivot from its initial position, parallel to the body, to its stapling position, perpendicular to the said driving mechanism and body.

2. A stapler as in claim 1, where said anvil is an integral part of the stapler's body and the sheaf of papers can be inserted only at one of the four corners of the sheaf of papers.

3. A stapler as in claim 1, where said anvil is pivotally connected to the stapler's body, so that the sheaf of papers can be introduced at any desired edge.

4. A stapler, comprising:

an elongated body; a magazine containing metal staples movably connected to said body between an initial position parallel to the body and a stapling position perpendicular to the body; a staple driving mechanism mounted to said body for linear movement relative to said body; an anvil flexibly mounted to said body to define an opening for a sheaf of papers, and a staple driving assembly, connected to said magazine containing the staples and said driving mechanism in such a manner that linear movement of the driving mechanism causes the magazine to move from its initial position parallel to the body to said stapling position perpendicular to said body.

5. A stapler as in claim 4, where the opening for paper insertion is closed from a plurality of directions so that the sheaf of papers can be inserted only at one of the four corners of the paper.

6. A stapler as in claim 4, where the opening for paper insertion is closed on three directions so that the sheaf of papers can be inserted at any desired edge.

* * * * *